US009267186B2

(12) United States Patent
Seo

(10) Patent No.: US 9,267,186 B2
(45) Date of Patent: Feb. 23, 2016

(54) METHOD FOR QUENCHING STEEL PIPE AND METHOD FOR PRODUCING STEEL PIPE USING THE SAME

(75) Inventor: Masanao Seo, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 533 days.

(21) Appl. No.: 13/819,842

(22) PCT Filed: Aug. 26, 2011

(86) PCT No.: PCT/JP2011/004758

§ 371 (c)(1),
(2), (4) Date: Feb. 28, 2013

(87) PCT Pub. No.: WO2012/029268

PCT Pub. Date: Mar. 8, 2012

(65) Prior Publication Data

US 2013/0160903 A1 Jun. 27, 2013

(30) Foreign Application Priority Data

Sep. 2, 2010 (JP) ..... 2010-196549

(51) Int. Cl.

| | |
|---|---|
| ***C21D 9/08*** | (2006.01) |
| ***C21D 1/63*** | (2006.01) |
| ***C21D 1/64*** | (2006.01) |
| ***C21D 9/00*** | (2006.01) |

(52) U.S. Cl.

CPC *C21D 9/085* (2013.01); *C21D 1/63* (2013.01); *C21D 1/64* (2013.01); *C21D 9/0018* (2013.01)

(58) Field of Classification Search

CPC ..... C21D 9/085

See application file for complete search history.

(56) References Cited

U.S. PATENT DOCUMENTS 3,877,685 A * 4/1975 Franceschina ..... C21D 9/085 266/102

FOREIGN PATENT DOCUMENTS

| | | | |
|---|---|---|---|
| JP | 55-125233 | | 9/1980 |
| JP | 58-022326 | | 2/1983 |
| JP | 59-035627 | | 2/1984 |
| JP | 59-074228 | | 4/1984 |
| JP | 61073830 | A * | 4/1986 |
| JP | 61127820 | A * | 6/1986 |
| JP | 7-090378 | | 4/1995 |
| JP | 8-041544 | | 2/1996 |

OTHER PUBLICATIONS

JP61-073830 English abstract.*
JP61-127820 English abstract.*
JP59-074228 written English translation.*

* cited by examiner

*Primary Examiner* — Keith Walker
*Assistant Examiner* — Stephani Gulbrandsen
(74) *Attorney, Agent, or Firm* — Clark & Brody

(57) ABSTRACT

In quenching, where a heated steel pipe (2) is immersed in a water bath (3) in parallel with water surface for cooling a pipe outer surface, and cooling water is injected from an axial center nozzle (8) into one end of pipe for cooling a pipe inner surface, thereby rapidly cooling the entire pipe surface, reduction of strength difference along a length of the quenched pipe becomes possible by moving the nozzle (8) following the motion of the pipe axis (2), and starting injecting the water from the nozzle (8) so as for the water to reach the other pipe end at the time of the immersion of the entire circumference of the pipe outer surface. An opening (3*a*) preferably faces the nozzle (8) to remove the water, and the flow velocity is preferably set to 23 m/sec or more for better water flow inside the pipe (2).

8 Claims, 5 Drawing Sheets

METHOD FOR QUENCHING STEEL PIPE AND METHOD FOR PRODUCING STEEL PIPE USING THE SAME

TECHNICAL FIELD

The present invention relates to a method for quenching a steel pipe, in which a heated steel pipe is immersed in a water bath to rapidly cool the pipe, and a method for producing a steel pipe by using the same, and particularly to a method for producing a steel pipe, which enables the difference in strength along a longitudinal direction of the quenched steel pipe to be decreased.

BACKGROUND ART

In order to produce a steel pipe having a desired strength, a heat treatment consisting of quenching and tempering is performed on the steel pipe during the production process thereof. When a steel pipe is quenched, a quenching method in which a heated steel pipe is immersed in a water bath for rapid cooling is often used, since such a method uses a large cooling capacity.

FIG. 1 is a schematic diagram showing an example of the process of immersing a heated steel pipe in a water bath. A quenching apparatus 1 shown in the same figure comprises a clamping device 5 for supporting a steel pipe 2, and a water bath 3. The clamping device 5 is made up of a first arm 6, and a second arm 7 which is swingably attached to the first arm. The first arm 6 includes a drive roller 61 and a roller 62 for supporting the steel pipe, and the second arm 7 includes a roller 71 for supporting the steel pipe.

When a heated steel pipe is immersed in a water bath by using a quenching apparatus shown in the same figure, the second arm 7 swings in a direction shown by an outlined arrow in the same figure, and the heated steel pipe is then placed on the drive roller 61 and the roller 62, which are included in the first arm 6. Thereafter, the second arm swings to return to a position shown in the same figure so that the heated steel pipe is rotatably supported by the drive roller 61 and the roller 62 included in the first arm and the two rollers 71 included in the second arm. While the steel pipe 2 is rotated in association with the rotation of the drive roller 61 (see the cross-hatched arrow in the same figure), the whole clamping device 5 swings as shown by the imaginary line in the same figure, thereby immersing the steel pipe in a water bath (see the diagonally shaded arrow).

The reason why the steel pipe is immersed in the water bath while being rotated is to prevent a partial decrease in strength for the steel pipe which has been quenched, which may occur when there is a difference in cooling rate between the water surface side and the water bath bottom side for the immersed steel pipe. In such an occasion, generally, a water flow is applied in an axial portion of the steel pipe to enhance the cooling effect of the steel pipe immersed in the water bath, and to uniformly cool the outer surface and the inner surface of the steel pipe.

FIG. 2 is a schematic diagram showing a conventional method for quenching a steel pipe, which is a process of generating a water flow in an axial portion of a steel pipe immersed in a water bath to rapidly cool the steel pipe. The same figure shows a water bath 3, a steel pipe 2 immersed in the water bath, and an axial center nozzle 8 disposed on the axis of the steel pipe. As shown in the same figure, by injecting cooling water to the axial portion at one end 2*a* of the steel pipe from the axial center nozzle 8, a water flow from one end 2*a* toward the other end 2*b* of the steel pipe is generated in the axial portion of the steel pipe (see the outlined arrow in the same figure). Hereafter, one end 2*a* of the steel pipe which is disposed near the axial center nozzle at the time of quenching is also referred to as a top end, and the other end 2*b* as a bottom end.

In a conventional method for quenching a steel pipe, by generating water flow in the axial portion of the steel pipe, the temperature of the inner surface of the steel pipe is prevented from becoming higher than that of the outer surface during rapid cooling, thus preventing the occurrence of a difference in strength between on the outer surface side and on the inner surface side of a steel pipe which has been quenched.

FIG. 3 is a diagram showing the relationship between the distance from the top end and yield strength in a steel pipe which has been quenched by a conventional method for quenching a steel pipe. In the same figure, the abscissa represents a distance (m) from the top end of the steel pipe, and the ordinate does a yield strength YS (MPa). The yield strengths shown in the same figure are those of a steel pipe which has been quenched by being heated and rapidly cooled. In rapid cooling of a heated steel pipe, a heated steel pipe is rotatably held by using a quenching apparatus equipped with a clamping device shown in FIG. 1 described above to be immersed in a water bath, and a water flow is generated in the axial portion of the steel pipe by the axial center nozzle disposed on the axis of the steel pipe shown in FIG. 2 described above. The steel pipe used for the quenching is made of carbon steel having strength corresponding to grade X65 of API standard, and has an outer diameter of 168.3 mm, a wall thickness of 18.52 mm, and a length of 12 m.

As shown in the same figure, in the conventional method for quenching a steel pipe, the yield strength declines on the bottom end side of the steel pipe compared with the top end side thereof. When the strength difference between on the top end side and on the bottom end side of the steel pipe increases, the product quality thereof will deteriorate, thus posing a grave problem.

Regarding the quenching method in which a heated steel pipe is immersed in a water bath to be rapidly cooled, various methods have been proposed including, for example, Patent Literatures 1 and 2. Patent Literature 1 has its objective to reduce the strength difference that occurs between on the top end side and on the bottom end side of a steel pipe which has been quenched, which is caused in such a manner that when a heated steel pipe is charged into a water bath with the axis thereof being kept in parallel with the water surface, buoyant force acts on the steel pipe due to air bubbles generated in the axial portion, and the bottom end tends to outcrop from the water surface, resulting in insufficient cooling. In the method for quenching a steel pipe according to Patent Literature 1, it teaches that a high-level progressive flow is formed by rapidly increasing the amount of water to be supplied to the water bath at the timing when the bottom end outcrops due to air bubbles, thereby increasing the water level in the area around the bottom end to prevent the bottom end of the steel pipe from outcropping from the water surface.

Further, Patent Literature 2 has its objective to solve a problem that flaws occur due to collision between the bottom end of the steel pipe and the wall surface of the water bath caused by a high-level progressive flow in the method for quenching a steel pipe according to Patent Literature 1. In the method for quenching a steel pipe according to Patent Literature 2, it teaches that by reducing the cross sectional area of the water bath on the bottom end side of the steel pipe, it is possible to reduce the amount of water necessary for forming a high level-progressive flow and to prevent the bottom end from outcropping from the water surface, deterring the axial movement of the steel pipe which is to be incurred by the water flow and to cause a collision between the bottom end and the wall surface of the water bath.

The quenching methods according to Patent Literatures 1 and 2, in which a heated steel pipe is immersed in a water bath, have their objectives to reduce the strength difference that occurs along a longitudinal direction of the steel pipe which has been quenched and is generated due to the outcropping of the bottom end of the steel pipe from the water surface during quenching. However, even when the quenching apparatus equipped with a clamping device shown in FIG. 1 described above is used and quenching is performed on the steel pipe without causing the bottom end side of the steel pipe to outcrop from the water surface, a difference in strength occurs between on the bottom end side and on the top end side of the steel pipe which has been quenched as shown in FIG. 3 described above.

CITATION LIST

Patent Literature

Patent Literature 1: Japanese Patent Application Publication No. 07-90378

Patent Literature 2: Japanese Patent Application Publication No. 08-41544

SUMMARY OF INVENTION

Technical Problem

As afore-described, in a conventional quenching method in which a heated steel pipe is immersed in a water bath, there is a problem that compared with the strength on the top end side which is closer to the axial center nozzle during rapid cooling in a steel pipe which has been quenched, the strength on the bottom end side, which is the other end, tends to be lower. The present invention has been made in view of such circumstances, and has its objective to provide a method for quenching a steel pipe which can suppress a difference in strength that occurs along a longitudinal direction of the steel pipe, and a method for producing a steel pipe using the same.

Solution to Problem

To solve the above described problem, the present inventors investigated the timing of the start of the injection of cooling water from an axial center nozzle when immersing a steel pipe in a water bath, in a method for quenching a steel pipe in which a heated steel pipe is immersed in a water bath to primarily cool the outer surface of the steel pipe, and a water flow is generated in an axial portion of the steel pipe by an axial center nozzle to primarily cool the inner surface of the steel pipe, thereby rapidly cooling the entire surface of the steel pipe. As a result, it was found that using a water supply nozzle as an axial center nozzle that moves following the motion of the axis of the steel pipe, and causing the cooling water, which is injected into one end of the steel pipe at the start of injection, to arrive at the other end when the entire circumference of the outer surface of the steel pipe is immersed will make it possible to ensure a required cooling rate in the vicinity of the bottom end of the steel pipe to be rapidly cooled, thereby suppressing a strength difference that occurs along a longitudinal direction of the steel pipe which has been quenched.

Furthermore, in the conventional quenching apparatus shown in FIG. 2 described above, it was found that providing an opening in the wall of the water bath opposite to the axial center nozzle, and taking out the cooling water from the opening to reduce water pressure in the vicinity of the bottom pipe end will make it possible to increase the velocity of a water flow generated in the axial portion of the steel pipe, thereby reducing the strength difference that occurs along a longitudinal direction of a steel pipe which has been quenched.

Further, it was found that setting the flow velocity to be not less than 23 m/sec to generate a water flow in the axial portion of the steel pipe will make it possible to reduce the strength difference that occurs along a longitudinal direction of a steel pipe that has been quenched.

The present invention has been completed based on the above described findings, and the summaries thereof includes methods for quenching a steel pipe shown by the below described (1) to (3), and a method for producing a steel pipe shown by the below described (4).

(1) A method for quenching a steel pipe, in which a heated steel pipe is immersed in a water bath with an axis thereof being kept in parallel with water surface to primarily cool an outer surface of the steel pipe, and a water flow from one end of the steel pipe to the other end thereof is generated in an axial portion of the steel pipe by injecting cooling water from an axial center nozzle to primarily cool an inner surface of the steel pipe, so that the entire surface of the steel pipe is rapidly cooled, the method for quenching a steel pipe including: moving the axial center nozzle following the motion of the axis of the steel pipe; and when the injection of cooling water is started from the axial center nozzle while keeping immersing the steel pipe in the water bath, starting the injection of cooling water such that the cooling water injected into one end of the steel pipe at the start of the injection arrives at the other end just at the time that the entire circumference of the outer surface of the steel pipe is made to be immersed.

(2) The method for quenching a steel pipe according to the above described (1), wherein an opening is provided opposite to the axial center nozzle on a wall surface of the water bath so that cooling water is taken out from the opening.

(3) The method for quenching a steel pipe according to the above described (1) or (2), wherein in generating a water flow in the axial portion of the steel pipe, a flow velocity is set to be not less than 23 msec.

(4) A method for producing a steel pipe, wherein in subjecting a steel pipe to quenching, quenching is performed by the quenching method according to any of the above described (1) to (3).

Advantageous Effects of Invention

The method for quenching a steel pipe of the present invention will achieve the following remarkable advantageous effects.

(1) It is possible to ensure a cooling rate in the vicinity of the bottom end of the steel pipe to be rapidly cooled, by causing the cooling water, which is injected into the top end of the steel pipe at the start of injection, to arrive at the bottom end when the entire circumference of the outer surface of the steel pipe is made to be immersed, and by taking out cooling water from the opening provided opposite to the axial center nozzle in the wall surface of the water bath.

(2) It is possible to generate a water flow in the axial portion of the steel pipe from a stage in which a part of the steel pipe is immersed in the water bath by moving the axial center nozzle following the motion of the axis of the steel pipe, thereby increasing the cooling rate of the steel pipe.

The method for producing a steel pipe of the present invention, which uses such methods for quenching a steel pipe, can reduce the strength difference that occurs along a longitudinal direction in a resulting steel pipe, thereby improving the quality thereof.

BRIEF DESCRIPTION OF DRAWINGS

FIG. 4(*b*) a stage in which a part of the outer circumference of the steel pipe is immersed in the water bath; FIG. 4(*c*) a stage in which the entire circumference of the steel pipe is made to be immersed in the water bath, and FIG. 4(*d*) a stage in which the steel pipe is disposed in the central region of the water bath, respectively.

DESCRIPTION OF EMBODIMENTS

Hereafter, a method for quenching a steel pipe of the present invention and a method for producing a steel pipe using the same are described with reference to the drawings.

Figure 4:
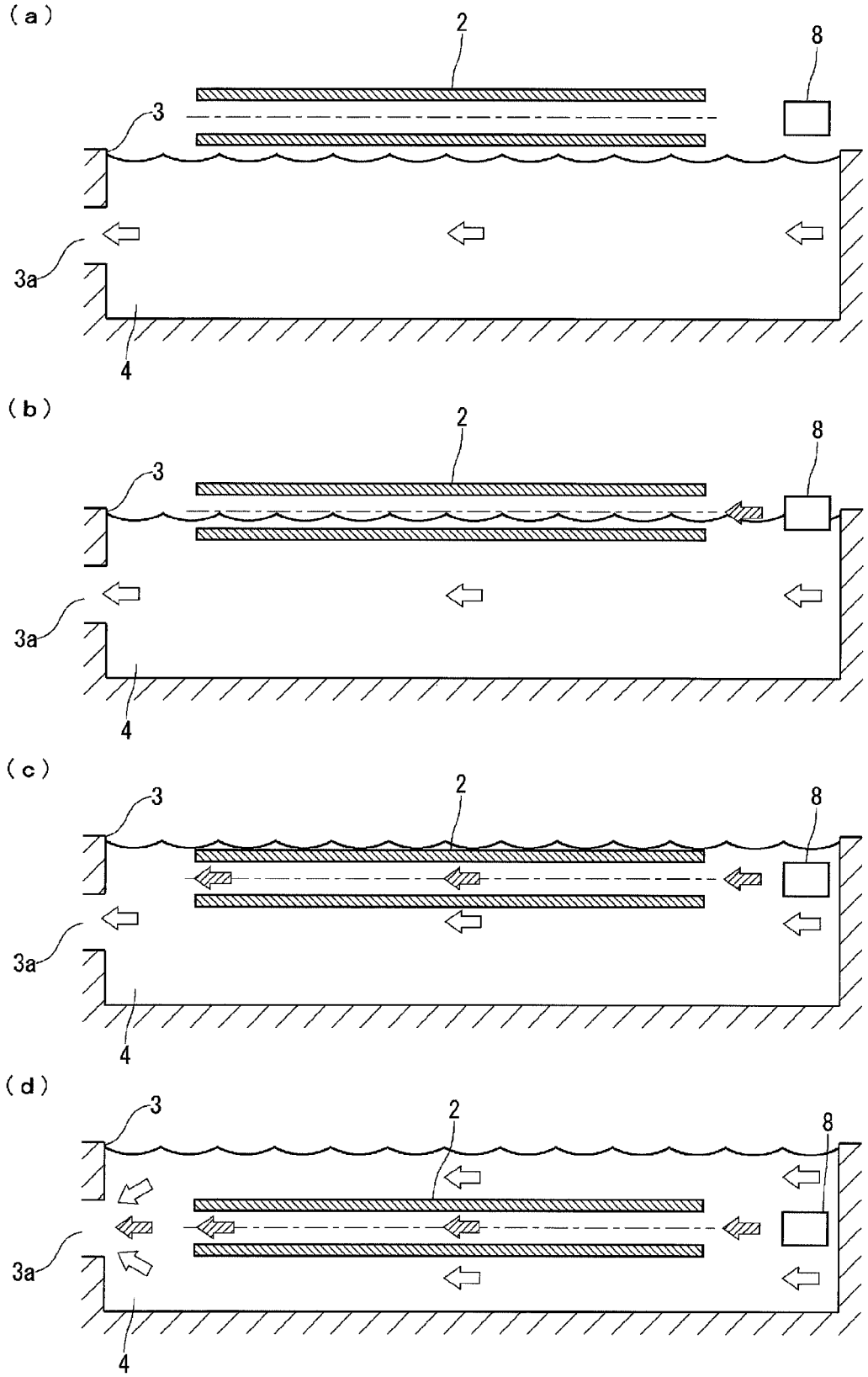
FIGS. 4(*a*) to 4(*d*) are schematic diagrams explaining an example of the quenching process by the method for quenching a steel pipe of the present invention, in which FIG. 4(*a*) shows a stage before the steel pipe is immersed in a water bath.

FIG. 4 is a schematic diagram explaining an example of quenching process by the method for quenching a steel pipe of the present invention, in which FIG. 4(*a*) shows a stage before the steel pipe is immersed in a water bath; FIG. 4(*b*) a stage in which a part of the outer circumference of the steel pipe is immersed in the water bath; FIG. 4(*c*) a stage in which the entire circumference of the steel pipe is made to be immersed in the water bath, and FIG. 4(*d*) a stage in which the steel pipe is disposed in the central region of the water bath, respectively. FIGS. 4(*a*) to 4(*d*) show a heated steel pipe 2, a water bath 3 for immersing the steel pipe therein, and an axial center nozzle 8 which moves following the motion of the axis of the steel pipe. The water bath 3 is provided with an opening 3*a* opposite to the axial center nozzle 8 in the wall surface of water bath, and a water supply nozzle whose configuration is not shown so that cooling water is supplied from the water supply nozzle and is taken out from the opening, thereby generating a water flow in the direction of outlined arrows of FIGS. 4(*a*) to 4(*d*).

In a quenching process by the method for quenching a steel pipe according to the present invention, which uses such a quenching apparatus as described above, a heated steel pipe is kept in a stage in which the axis thereof is parallel with the water surface as shown in FIG. 4(*a*). In this occasion, the injection of cooling water from the axial center nozzle 8 is refrained.

Next, while the steel pipe is moved downward to be immersed in the water bath, the injection from the axial center nozzle 8 toward one end (top end) of the steel pipe is started as shown in FIG. 4(*b*) (see the diagonally shaded arrow in FIG. 4(*b*)).

After the injection by the axial center nozzle is started, the steel pipe is successively moved downward, and the cooling water, which has been injected into one end (top end) of the steel pipe at the start of the injection, is caused to arrive at the other end (bottom end) when the entire circumference of the outer surface of steel pipe is made to be immersed as shown in FIG. 4(*c*) (see the diagonally shaded arrows in FIG. 4(*c*)).

After the entire circumference of the outer surface of steel pipe is made to be immersed, the steel pipe is successively moved downward so as to be disposed in the central region of the water bath as shown in FIG. 4(*d*) so that the steel pipe is cooled to a temperature not more than ambient temperature by supplying cooling water to the water bath from the axial center nozzle 8 and the water supply nozzle, and taking it out from the opening 3*a*, and thereafter the steel pipe is taken up from the water bath.

The method for quenching a steel pipe of the present invention is a method for quenching a steel pipe, in which a heated steel pipe is immersed in a water bath with an axis thereof being kept in parallel with water surface to primarily cool an outer surface of the steel pipe, and a water flow from one end of the steel pipe to the other end thereof is generated in an axial portion of the steel pipe by injecting cooling water from an axial center nozzle to primarily cool an inner surface of the steel pipe, so that the entire surface of the steel pipe is rapidly cooled, the method for quenching a steel pipe including: moving the axial center nozzle following the motion of the axis of the steel pipe, and when the injection of cooling water is started from the axial center nozzle while keeping immersing the steel pipe in the water bath, starting the injection of cooling water such that the cooling water injected into one end of the steel pipe at the start of the injection arrives at the other end when entire circumference of the outer surface of the steel pipe is made to be immersed.

As described by using FIGS. 4(*a*) to 4(*d*), when the injection of cooling water is started from the axial center nozzle while keeping immersing the steel pipe in the water bath, the injection is started such that the cooling water, which is injected into one end of the steel pipe at the start of the injection, arrives at the other end when the entire circumference of the outer surface of the steel pipe is made to be immersed. Since this allows the vicinity of the bottom end of steel pipe to be cooled from the inner surface and the outer surface concurrently, it is possible to ensure the sufficient cooling rate in the vicinity of the bottom end thereby suppressing the deterioration of strength, and reduce the strength difference that occurs along a longitudinal direction of the steel pipe which has been quenched.

If the timing to start the injection of cooling water by the axial center nozzle is early, the inner surface in the vicinity of the bottom end is cooled by the water flow in the axial portion before a part of the outer surface of the steel pipe is immersed in the water bath. Since, for this reason, the vicinity of the bottom end is temporarily cooled only by the cooling water from the inner surface, the cooling rate in the vicinity of the bottom end becomes insufficient, causing a remarkable deterioration of strength and resulting in an increase in the strength difference along a longitudinal direction of a steel pipe which has been quenched.

On the other hand, if the timing to start the injection of cooling water by the axial center nozzle is late, the inner surface in the vicinity of the bottom end is cooled by the water flow in the axial portion after the entire circumference of the outer surface in the vicinity of the bottom end of the steel pipe is made to be immersed in the water bath. For this reason, the cooling from the inner surface becomes temporarily insufficient in the vicinity of the bottom end so that the cooling rate in the vicinity of the bottom end becomes insufficient, thus causing a remarkable deterioration of strength and resulting in an increase in the strength difference along longitudinal direction of a steel pipe which has been quenched.

One conceivable method for synchronizing the timing at which the cooling water injected into one end of the steel pipe at the start of injection arrives at the other end, with the timing at which the entire circumference of the outer surface of the steel pipe is made to be immersed is a method of adjusting the velocity at which the steel pipe is moved downward to the water surface, the flow velocity of the water flow generated in the axial portion, and the timing to start the injection by the axial center nozzle. Since, in the quenching of a steel pipe, it is important to cool the steel pipe as rapidly as possible to secure the strength thereof, operation is preferably performed at upper limits of equipment capability for the velocity at which the steel pipe is moved downward to the water surface and the flow velocity in the axial portion. For this reason, in the quenching method of the present invention, it is preferable to cause the cooling water, which is injected into one end of the steel pipe when injection is started, to arrive at the other end when the entire circumference of the outer surface of steel pipe is made to be immersed, by adjusting the timing to start the injection of cooling water by the axial center nozzle.

Figure 1:
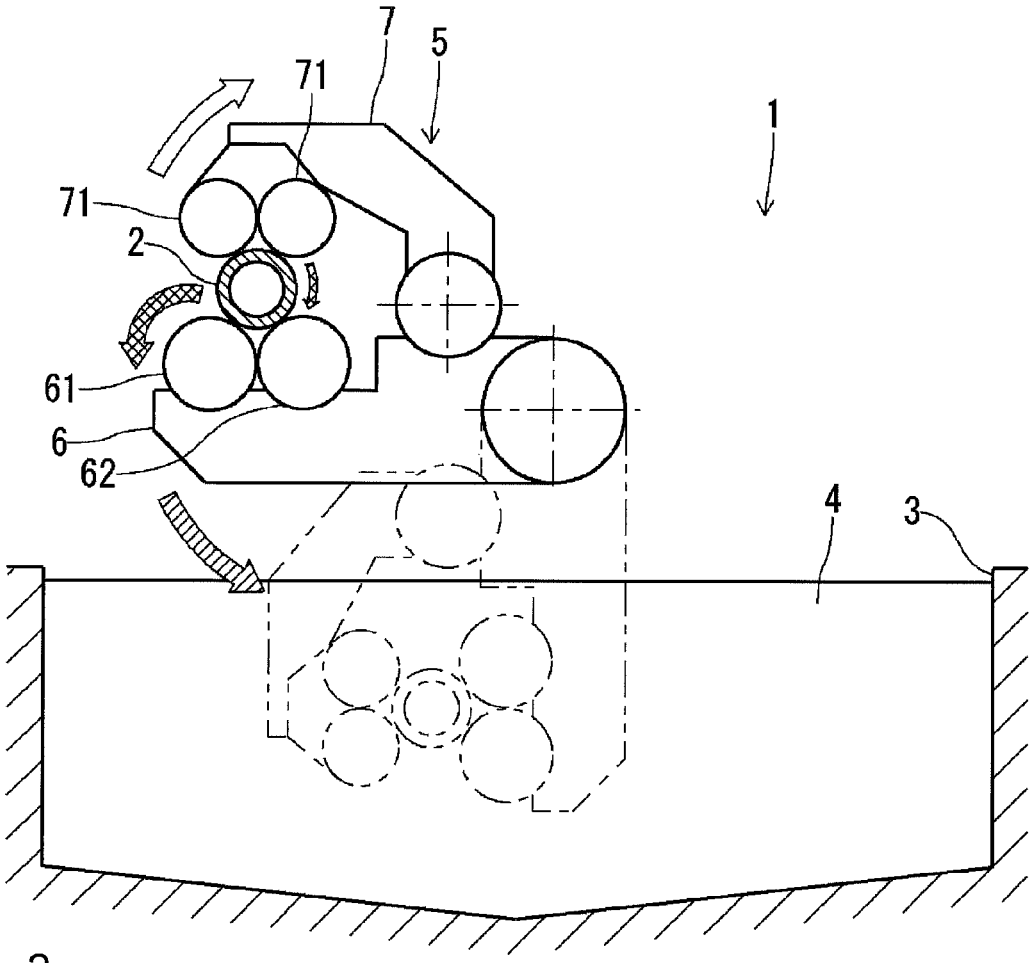
FIG. 1 is a schematic diagram showing an example of the process of immersing a heated steel pipe in a water bath.
Figure 2:
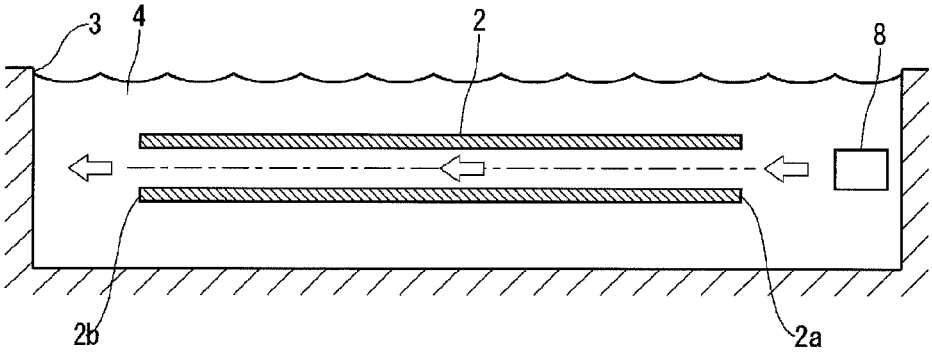
FIG. 2 is a schematic diagram showing a conventional method for quenching a steel pipe, which is a process of generating a water flow in an axial portion of the steel pipe immersed in a water bath thereby rapidly cooling the steel pipe.
Figure 3:
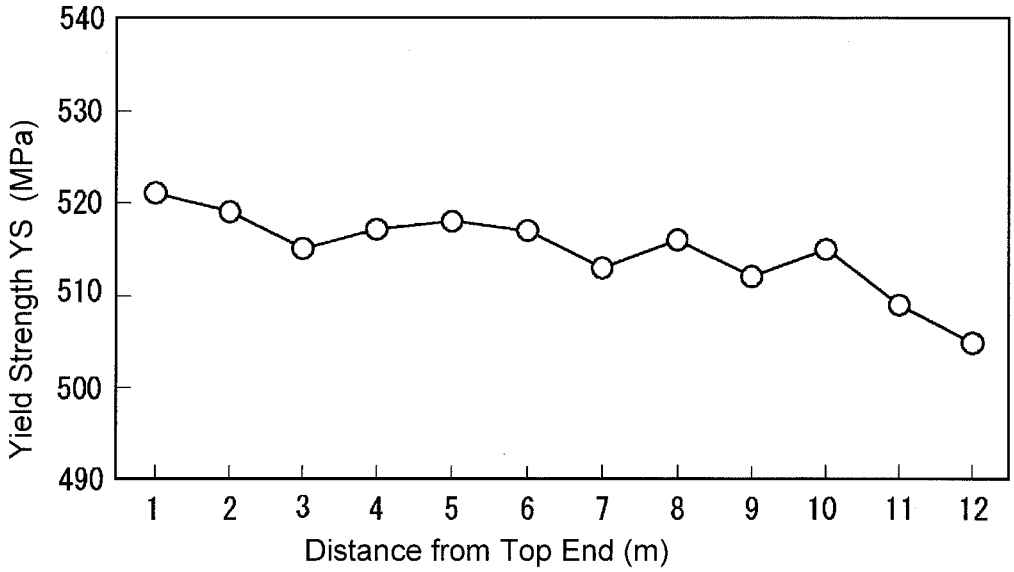
FIG. 3 is a diagram showing the relationship between a distance from the top end and a yield strength in a steel pipe which has been quenched by a conventional method for quenching a steel pipe.

By moving the axial center nozzle following the motion of the axis of the steel pipe, it is possible to generate a water flow in the axial portion of a steel pipe from a stage in which a part of the steel pipe is immersed in the water bath, thereby improving the cooling rate of the steel pipe to be immersed in the water bath. As the method for moving the axial center nozzle following the motion of the axis of the steel pipe, for example, a method of immobilizing the axial center nozzle to a first arm 6 of a clamping device 5 shown in FIG. 1 described above by using a jig can be adopted. This makes it possible to move the axial center nozzle following the motion of the axis of the steel pipe, and rapidly cool the steel pipe without the bottom end side being caused to float up to the water surface by water bubbles. Further, immersing the steel pipe while rotating it by a clamping device makes it possible to prevent the strength from partially deteriorating in a steel pipe which has been quenched caused by that the cooling rate is different in a steel pipe between on the water surface side and on the bottom face side of water bath during rapid cooling.

In the method for quenching a steel pipe of the present invention, it is preferable that an opening is provided opposite to the axial center nozzle in a wall surface of the water bath, and cooling water is taken out from the opening portion. Taking out the cooling water from the opening provided opposite to the axial center nozzle in the wall surface of the water bath will result in a decline of water pressure in the area around the opening, that is, on the bottom end side. For this reason, the water pressure difference between on the top end and on the bottom end increases so that it becomes possible to increase the flow velocity of the water flow generated in the axial portion. Further, it is possible to efficiently take out the cooling water, which has been used for cooling the steel pipe rises in temperature, and stays in the area around the bottom end, from the opening. These make it possible to increase the cooling rate of the bottom end side of the steel pipe when it is rapidly cooled so that it is possible to reduce the strength difference that occurs along a longitudinal direction of the steel pipe which has been quenched.

In the method for quenching a steel pipe of the present invention, it is preferable that the flow velocity of the water flow to be generated in the axial portion of the steel pipe is not less than 23 m/sec as will be described below regarding Examples in FIG. 6. That is because, as shown in the same figure, when the flow velocity of the water flow to be generated in the axial portion increases, the strength difference along a longitudinal direction of the steel pipe which has been quenched decreases, so that making the flow velocity not less than 23 m/sec can reduce the strength difference to be not more than 20 MPa.

Thus, in the method for quenching a steel pipe of the present invention, by specifying the timing to start the injection of cooling water from the axial center nozzle, and taking out the cooling water from the opening provided opposite to the axial center nozzle in the wall surface of water bath, it is possible to ensure an enough cooling rate in the vicinity of the bottom end of the steel pipe to be rapidly cooled. According to the method for producing a steel pipe of the present invention by using the above described quenching method, it is possible to suppress the deterioration of strength on the bottom end side of the resultant steel pipe thereby reducing the strength difference that occurs along a longitudinal direction, and thus increasing the quality thereof.

Examples

Tests for quenching a steel pipe were conducted to validate the effects of the method for quenching a steel pipe of the present invention and the method for producing a steel pipe using the same.

[Test Method]

In the present tests, quenching was performed by immersing a steel pipe in a water bath to rapidly cool it according to the procedure described with reference to FIGS. 4(*a*) to 4(*d*) described above. In this occasion, a heated steel pipe was rotatably supported by the quenching apparatus shown in FIG. 1 described above, which was equipped with an axial center nozzle which moves following the motion of the axis of the steel pipe. A material grade having a low hardenability was chosen as the material grade of the steel pipe to be quenched to reveal the effect of the difference in quenching condition.

Test conditions in the present test were as follows.

Steel pipe: outer diameter 114.3 mm, wall thickness 12.5 mm, length 12000 mm; material grade: carbon steel capable of having a strength corresponding to 5L2-X65Q grade of API standard.

In Inventive Example 1 of the present invention, the timing to start the injection of cooling water from the axial center nozzle was adjusted so as to cause the cooling water, which was injected into one end (top end) of the steel pipe when the injection was started, to arrive at the other end (bottom end) just at the time that the entire circumference of the outer surface of steel pipe was made to be immersed. Further, in Inventive Example 1 of the present invention, two pumps were used to supply cooling water to the axial center nozzle, and cooling water was injected into the axial portion at the top end of the steel pipe.

In Comparative Example 1, the timing to start the injection of cooling water from the axial center nozzle was brought forward compared with Inventive Example 1 of the present invention so as to cause the cooling water, which was injected into the top end when the injection was started, to arrive at the bottom end before the entire circumference of the outer surface of steel pipe was made to be immersed. In Comparative Example 2, the timing to start the injection of cooling water from the axial center nozzle was delayed compared with Inventive Example 1 of the present invention so as to cause the cooling water, which was injected into the top end when the injection was started, to arrive at the bottom end after the entire circumference of the outer surface of steel pipe was made to be immersed.

In Inventive Example 2 of the present invention, the diameter of the axial center nozzle was decreased compared with Inventive Example 1 of the present invention so that the flow velocity of the water flow generated in the axial portion was reduced. In Inventive Example 3 of the present invention, the number of the pumps for supplying cooling water to the axial center nozzle was one such that the flow velocity of the water flow to be generated in the axial portion was reduced compared with Inventive Examples 1 and 2 of the present invention. Table 1 shows: a period of time between the contact of the outer surface of steel pipe with the water surface and the start of the injection of cooling water by the axial center nozzle; the method for injecting cooling water by the axial center nozzle; and the flow velocity of the water flow generated in the axial portion of the steel pipe in each of Inventive Examples 1 to 3 of the present invention and Comparative Examples 1 and 2.

been quenched. In the same figure, the timing to start the injection of cooling water from the axial center nozzle is shown by a period of time (sec) between the contact of the outer surface of the steel pipe to be immersed in the water bath with the water surface and the start of the injection of cooling water by the axial center nozzle.

As shown in the same figure, in Comparative Example 1, in which the timing to start the injection by the axial center nozzle was brought forward, and a period of time between the contact of the outer surface of steel pipe with the water surface and the start of the injection by the axial center nozzle was 0.01 sec, the strength difference of yield strength YS was 26 MPa and the strength difference of tensile strength was 23 MPa. In Comparative Example 2, in which the timing to start the injection by the axial center nozzle was delayed such that a period of time between the contact of the outer surface of steel pipe with the water surface and the start of the injection by the axial center nozzle was 0.50 sec, the strength difference of yield strength YS was 31 MPa and the strength difference of tensile strength TS was 31 MPa.

On the other hand, in Inventive Example 1 of the present invention, to cause the cooling water, which was injected into the top end of the steel pipe at the start of injection, to arrive at the bottom end just at the time that the entire circumference of the outer surface of the steel pipe was made to be immersed, a period of time between the contact of the outer surface of steel pipe with the water surface and the start of the injection by the axial center nozzle was 0.06 sec, and the

TABLE 1

| Classification | Time between contact of outer surface of steel pipe with water surface and start of water injection | Timing for cooling water injected into one end of steel pipe at the start of injection to arrive at the other end | Method for injecting cooling water by axial center nozzle | Flow velocity of water flow generated in axial portion |
|---|---|---|---|---|
| Inventive Example 1 of the present invention | 0.06 sec | At the same time that entire circumference of outer surface of steel pipe is immersed | Two pumps are used | 24.5 m/sec |
| Comparative Example 1 | 0.01 sec | Before the entire circumference of outer surface is immersed | Two pumps are used | 24.3 m/sec |
| Comparative Example 2 | 0.50 sec | After the entire circumference of outer surface is immersed | Two pumps are used | 24.3 m/sec |
| Inventive Example 2 of the present invention | 0.06 sec | At the same time that entire circumference of outer surface of steel pipe is immersed | Two pumps, and a small-diameter axial center nozzle are used | 19.2 m/sec |
| Inventive Example 3 of the present invention | 0.06 sec | At the same time that entire circumference of outer surface of steel pipe is immersed | One pump is used | 13.3 m/sec |

[Evaluation Procedure]

As an evaluation procedure, tensile strength TS and yield strength YS on the top end side and the bottom end side of the steel pipe were examined to calculate strength differences along a longitudinal direction, respectively. No. 12 tensile test specimens specified by JIS Z 2201 were taken from the vicinities of the top end and bottom end of the steel pipe, and tensile tests were conducted according to the test method specified by JIS Z 2241 to obtain tensile strength TS and yield strength YS.

[Test Results]

Figure 5:
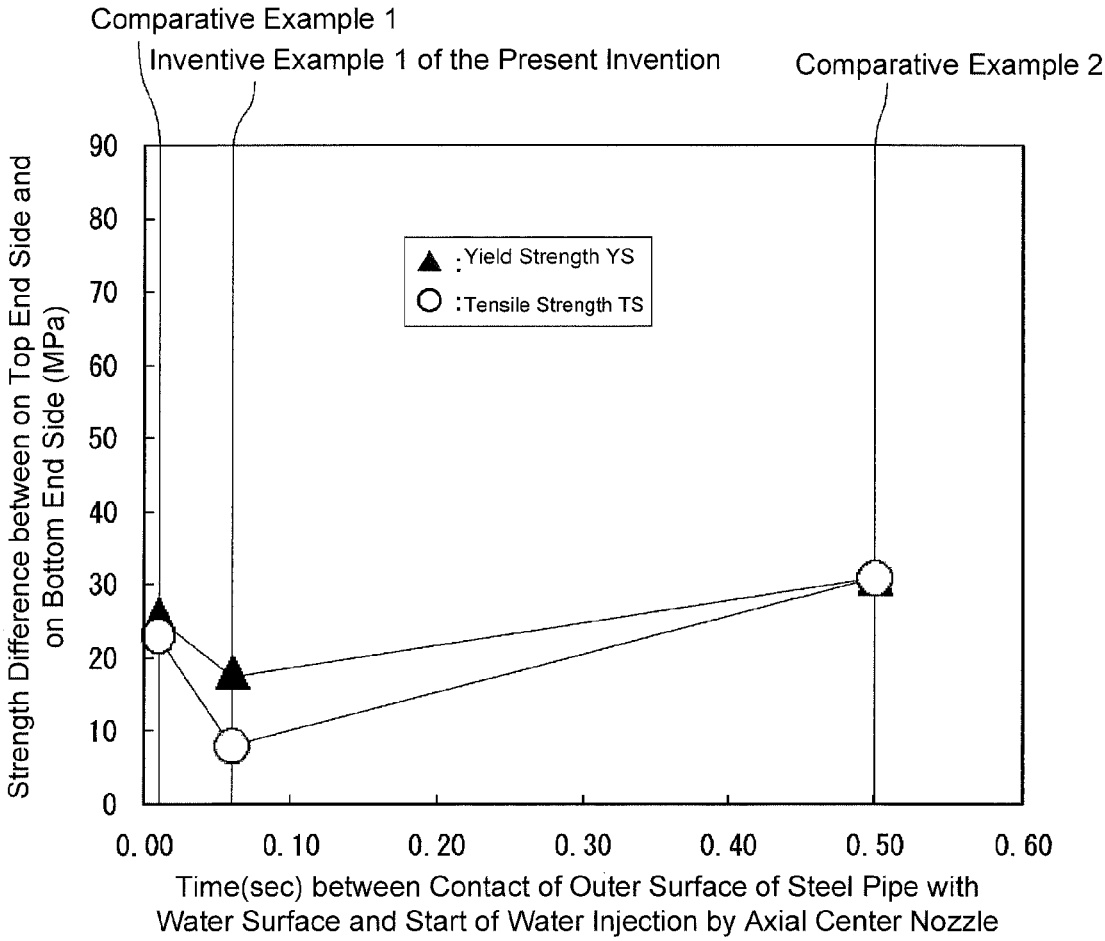
FIG. 5 is a diagram showing the relationship between the timing to start the injection of cooling water from an axial center nozzle and the strength difference between on the top end side and on the bottom end side of a steel pipe which has been quenched.

FIG. 5 is a diagram showing the relationship between the timing to start the injection of cooling water from an axial center nozzle and the strength difference between on the top end side and on the bottom end side of a steel pipe which has strength difference of yield strength YS was 18 MPa and the strength difference of tensile strength TS was 8 MPa. From these results, it has been confirmed that by adjusting the timing to start the injection of cooling water from the axial center nozzle according to the method for quenching a steel pipe of the present invention so as to cause the cooling water, which is injected into the top end of the steel pipe at the start of injection, to arrive at the bottom end just at the time that the entire circumference of the outer surface of the steel pipe is made to be immersed, the strength difference along a longitudinal direction of a steel pipe which has been quenched is reduced.

Figure 6:
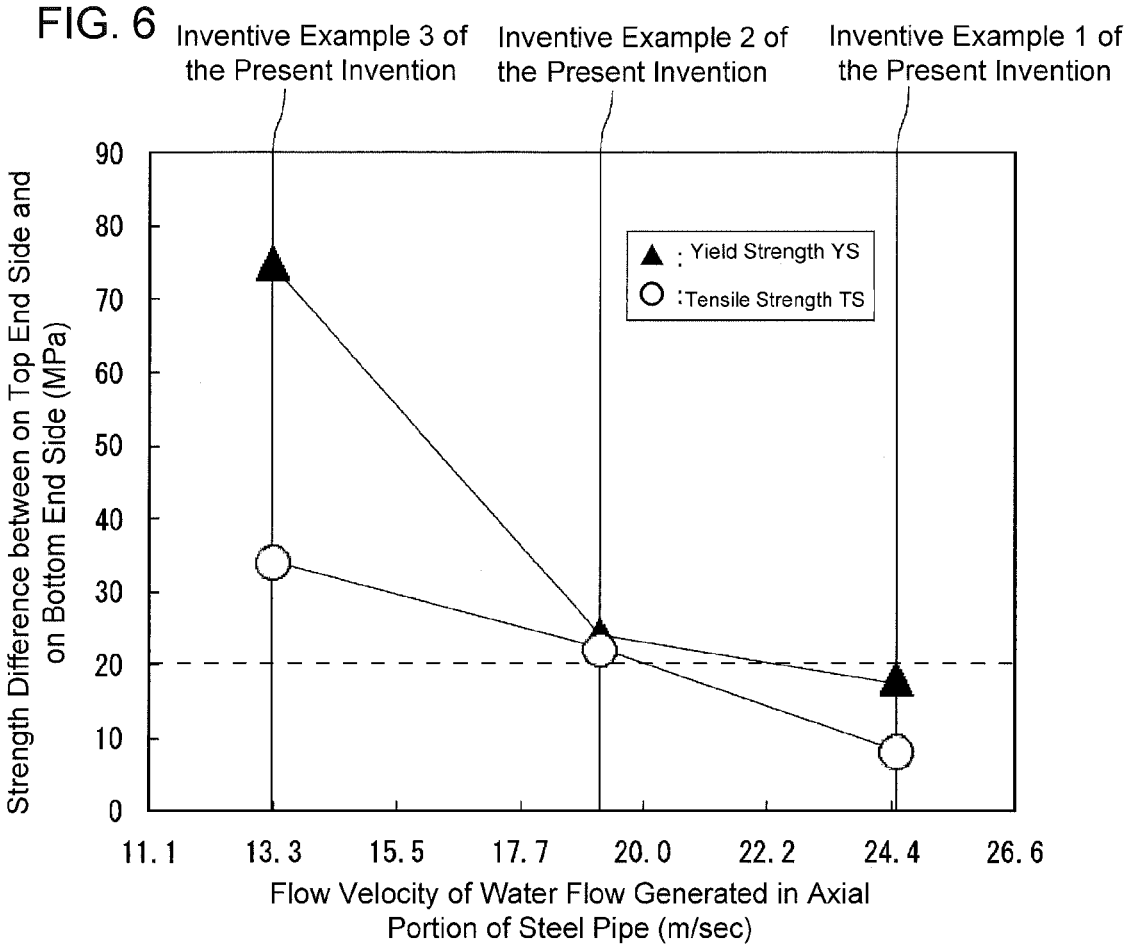
FIG. 6 is a diagram showing the relationship between the flow velocity of the water flow generated in the axial portion of the steel pipe and the strength difference between on the top end side and on the bottom end side of the steel pipe which has been quenched.

FIG. 6 is a diagram showing the relationship between the flow velocity of the water flow generated in the axial portion of the steel pipe and the strength difference between on the top end side and on the bottom end side of the steel pipe which has been quenched. As shown in the same figure, in Inventive Example 2 of the present invention, in which the flow velocity of the water flow in the axial portion was lowered to 19.2 m/sec compared with 24.5 msec in Inventive Example 1 of the present invention, the strength difference of yield strength YS was 24 MPa and the strength difference of tensile strength TS was 22 MPa. Further, in Inventive Example 3 of the present invention, in which the flow velocity of the water flow in the axial portion is further lowered to 13.3 m/sec, the strength difference of yield strength YS was 75 MPa and the strength difference of tensile strength TS was 34 MPa.

Thus, it has been confirmed that a decrease in the flow velocity to be generated in the axial portion of a steel pipe during rapid cooling will increase the strength difference along a longitudinal direction of a steel pipe which has been quenched. Further, from the same figure, it has been confirmed that making the flow velocity to be generated in the axial portion of the steel pipe not less than 23 msec will reduce the strength differences of the yield strength YS and the tensile strength TS of the steel pipe which has been quenched to not more than 20 MPa.

INDUSTRIAL APPLICABILITY

The method for quenching a steel pipe of the present invention will achieve the following remarkable advantageous effects.

(1) It is possible to ensure a cooling rate in the vicinity of the bottom end of the steel pipe to be rapidly cooled, by causing the cooling water, which is injected into the top end of the steel pipe at the start of injection, to arrive at the bottom end just at the time that the entire circumference of the outer surface of the steel pipe is made to be immersed, and by taking out cooling water from the opening provided opposite to the axial center nozzle in the wall surface of the water bath.

(2) It is possible to generate a water flow in the axial portion of the steel pipe from a stage in which a part of the steel pipe is immersed in the water bath by moving the axial center nozzle following the motion of the axis of the steel pipe, thereby increasing the cooling rate of the steel pipe.

The method for producing a steel pipe of the present invention, which uses the above described methods for quenching a steel pipe, can reduce the strength difference that occurs along a the longitudinal direction in a resulting steel pipe, thus improving the quality thereof, and therefore is useful in the production of high-strength and high-quality steel pipes.

REFERENCE SIGNS LIST

1: Quenching apparatus
2: Steel pipe
2*a*: Top end
2*b*: Bottom end
3: Water bath
3*a*: Opening
4: Cooling water
5: Clamping device
6: First arm
61: Drive roller
62: Roller
7: Second arm
71: Roller
8: Axial Center nozzle

What is claimed is:

1. A method for quenching a steel pipe, in which a heated steel pipe is immersed in a water bath with an axis thereof being kept in parallel with water surface to primarily cool an outer surface of the steel pipe, and a water flow from one end of the steel pipe to the other end thereof is generated in an axial portion of the steel pipe by injecting cooling water from an axial center nozzle to primarily cool an inner surface of the steel pipe, so that an entire surface of the steel pipe is rapidly cooled, the method for quenching a steel pipe comprising:

moving the axial center nozzle following the motion of the axis of the steel pipe, and when the injection of cooling water is started from the axial center nozzle while the steel pipe is being immersed in the water bath, starting the injection of cooling water such that the cooling water injected into one end of the steel pipe at the start of the injection arrives at the other end just at the time that an entire circumference of the outer surface of the steel pipe is immersed.

2. The method for quenching a steel pipe according to claim 1, wherein an opening is provided opposite to the axial center nozzle on a wall surface of the water bath so that cooling water is taken out from the opening.

3. The method for quenching a steel pipe according to claim 1, wherein in generating a water flow in the axial portion of the steel pipe, a flow velocity is set to be not less than 23 m/sec.

4. A method for producing a steel pipe, wherein in subjecting a steel pipe to quenching, quenching is performed by the quenching method according to claim 1.

5. The method for quenching a steel pipe according to claim 2, wherein in generating a water flow in the axial portion of the steel pipe, a flow velocity is set to be not less than 23 m/sec.

6. A method for producing a steel pipe, wherein in subjecting a steel pipe to quenching, quenching is performed by the quenching method according to claim 2.

7. A method for producing a steel pipe, wherein in subjecting a steel pipe to quenching, quenching is performed by the quenching method according to claim 3.

8. A method for producing a steel pipe, wherein in subjecting a steel pipe to quenching, quenching is performed by the quenching method according to claim 5.

* * * * *